US005668563A

United States Patent [19]

Ogino et al.

[11] Patent Number: 5,668,563

[45] Date of Patent: Sep. 16, 1997

[54] INTEGRAL TYPE FLAT ANTENNA PROVIDED WITH CONVERTER FUNCTION

[75] Inventors: Toshikazu Ogino; Hayato Shibano; Eiki Hosaka, all of Kanagawa, Japan

[73] Assignee: Mitsumi Electric Co., Ltd., Tokyo, Japan

[21] Appl. No.: 593,931

[22] Filed: Jan. 30, 1996

[30] Foreign Application Priority Data

Jan. 31, 1995 [JP] Japan ..... 7-014593

[51] Int. Cl.[6] ..... H01Q 1/32; H01Q 1/38

[52] U.S. Cl. ..... 343/713; 343/700 MS

[58] Field of Search ..... 343/700 MS, 702, 343/713; H01Q 1/38, 23/00

[56] References Cited

U.S. PATENT DOCUMENTS

| | | | |
|---|---|---|---|
| 4,918,457 | 4/1990 | Gibson | 343/700 MS |
| 4,943,809 | 7/1990 | Zaghloul | 343/700 MS |
| 5,181,025 | 1/1993 | Ferguson et al. | 343/700 MS |
| 5,315,753 | 5/1994 | Jensen et al. | 29/600 |
| 5,323,168 | 6/1994 | Itoh et al. | 343/700 MS |
| 5,534,879 | 7/1996 | Braun et al. | 343/713 |
| 5,539,420 | 7/1996 | Dusseux et al. | 343/700 MS |

FOREIGN PATENT DOCUMENTS

| | | | |
|---|---|---|---|
| 6045824 | 2/1994 | Japan | H01Q 23/00 |

*Primary Examiner*—Donald T. Hajec
*Assistant Examiner*—Tan Ho
*Attorney, Agent, or Firm*—Hill, Steadman & Simpson

[57] ABSTRACT

An integral type flat antenna provided with a converter function includes an antenna element having a feeding point and an integrally formed multilayered substrate for supporting the antenna element thereon. The multilayered substrate includes a grounding plane layer on which the antenna element is mounted, a first insulating layer provided below the grounding plane layer, a second insulating layer positioned below the first insulating layer and provided with a frequency conversion circuit for carrying out a converter function on frequency of received signals, the frequency conversion circuit having a signal input portion which is positioned at one end of the second insulating layer, and a conducting layer provided between the first and second insulating layers for connecting the feeding point of the antenna element to the signal input section of the frequency conversion circuit.

12 Claims, 3 Drawing Sheets

INTEGRAL TYPE FLAT ANTENNA PROVIDED WITH CONVERTER FUNCTION

BACKGROUND OF THE INVENTION

1. Field of the Invention

The present invention relates to an integral type flat antenna provided with a converter function, and in particular relates to an integral type flat antenna provided with a converter function which is mainly designed to receive electromagnetic waves transmitted from satellites. More specifically state, the flat antenna of the present invention is designed to serve as a GPS (Global Positioning System) antenna for receiving electromagnetic waves from GPS satellites, and such an antenna is particularly used for car navigation systems.

2. Description of the Prior Art

Various types of integral type flat antennas provided with converter functions are known in the prior art, and one of these antennas for GPS use is shown in FIG. 1.

In this regard, FIG. 1 is a cross-sectional view of a conventional integral type GPS antenna provided with a converter function. As shown in this drawing, the GPS antenna is basically constructed from an antenna element 1, an antenna substrate 5 which supports the antenna element 1 thereon, and a housing 12 made from a steel plate which is provided below the antenna substrate 5 to support the antenna substrate 5.

The antenna element 1 includes a dielectric portion 1*a* made from a dielectric substance such as ceramic or the like and a feeding point 2 provided roughly in the center of the top surface of the dielectric portion 1*a*. Now, because the surrounding environment can give rise to the formation of static charges to the dielectric portion 1*a*, the antenna element 1 needs to be grounded in order to stabilize its characteristics. To accomplish this, grounding planes 3, 4 made of copper foil are provided on the top and bottom surfaces of the antenna substrate 5. Further, grounding is established by mounting the antenna element 1 in the center of the top surface of the grounding plane 3 which is provided on the top surface of the antenna substrate 5 and by connecting the grounding plane 3 to an earth via an outer conductor of a coaxial cable 20 (described below).

Further, a terminal portion 6 extends downwards from the feeding point 2 of the antenna element 1 through the inside of the antenna element 1 and through a through-hole 7 formed in the antenna substrate 5 so as to protrude below the bottom surface of the antenna substrate 5. The protruding portion of the terminal portion 6 is soldered to the antenna substrate 5 at a soldering portion 8. Further, a receptacle 9 is provided below the antenna substrate 5 in the vicinity of the through-hole 7, and the receptacle 9 1s connected to the soldering portion 8 via a circuit pattern 10.

Furthermore, the grounding plane 4 provided below the antenna substrate 5 has cut-out portions around the border of the soldering portion 8, circuit pattern 10 and receptacle 9, and thereby it is electrically insulated from these elements. Further, the grounding plane 3 provided on the top of the antenna substrate 5 is also electrically insulated from the terminal portion 6.

Further, positioning apertures 11, 11 are formed in the antenna substrate 5, and bosses 13, 13 are erected on the upper surface of an upper case 12*a* of a housing 12 at positions corresponding to the positioning apertures 11, 11. In this way, the antenna substrate 5 equipped with the antenna element 1 is mounted onto the upper case 12*a* by fitting the positioning apertures 11, 11 over the bosses 13, 13.

Provided inside the upper ease 12*a* is a front end substrate 17 on which a frequency conversion circuit 16 is mounted. The frequency conversion circuit 16 is constructed by mounting electrical parts 15, 15, such as integrated circuits, oscillators and the like, onto the bottom surface of a double-sided substrate 14. Further, square-shaped apertures 18, 19 are formed roughly in the center of the upper case 12*a* and the front end substrate 17, respectively, at positions which correspond to the receptacle 9. Further, one end of the inner conductor of the coaxial cable 20, which serves as a feeding line having a predetermined impedance (e.g., 50 Ω), is connected to the receptacle 9 and the other end of the inner conductor is connected to the frequency conversion circuit 16 of the front end substrate 17 via the square-shaped apertures 18, 19. In this regard, as was explained above, in order to ground the antenna element 1, one end of the outer conductor of the coaxial cable 20 is connected to the grounding plane 4 and the other end thereof is connected to the housing 12 and the like.

Now, because GPS electromagnetic waves and the like transmitted from satellites are generally high frequency waves in the gigahertz range of 3–30 GHz, the signal characteristics can easily be deteriorated when electric signals based on such received electromagnetic waves are processed in the frequency conversion circuit 16. For this reason, in order to prevent such deterioration in signal characteristics, it is preferred that the frequency conversion circuit 16 has a circuit design in which signals flow as linear as possible.

Thus, in such prior art GPS antenna, the coaxial cable 20 bends roughly 90 degrees after passing through the square-shaped apertures 18, 19 and then runs parallel to the underside surface of the front end substrate 17 until it reaches a position near one end of the front end substrate 17 (shown in the drawing as the right end). At that position, the coaxial cable 20 is connected to a receptacle 21 which 1s provided on the front end substrate 17 to act as a signal input portion. Further, the circuitry is designed such that the signals which are inputted at the input portion of the frequency conversion circuit 16 (i.e., the receptacle 21) flow roughly linearly toward the other end of the front end substrate 17 (shown in the drawing as the left end) and reach an output connector 22 provided at the other end of the front end substrate 17 to act as an output portion.

Now, because this type of GPS antenna is mainly used for car navigation system, it is generally fixed to the top surface of a car's trunk or the like. For this reason, it is preferred that the antenna be made as thin as possible.

However, as described above, in such prior art integral type GPS antenna provided with a conversion function, two substrates, namely the antenna substrate 5 and the frequency conversion circuit substrate 17 (i.e., the front end substrate 17) must be provided separately, and only the front end substrate 17 is housed inside the housing 12. Further, because the coaxial cable 20 for connecting the feeding point 2 of the antenna element 1 and the frequency conversion circuit 16 must run below the front end substrate 17 up to the signal input portion (receptacle) 21, a prescribed space must be provided below the front end substrate 17. For these reasons, the housing must have a specific height, and in addition it is also necessary for the antenna to have a certain height for mounting the antenna substrate 5 above the housing 12. Therefore, it is very difficult to construct a thinner-type flat antenna.

Moreover, because such prior art antenna requires two substrates that must be manufactured separately as well as the coaxial cable, there is an increase in the number of parts and the number of manufacturing steps. Such structure leads to a complex manufacturing process, and it also leads to high manufacturing costs due to the relatively expensive price of coaxial cables.

Furthermore, when used for car navigation, it is preferred that such GPS antennas be constructed so as to be resistant to vibrations transmitted from the car. However, in the structure described above, it is easy for the antenna to be affected by such vibrations because the antenna element 1 and the antenna substrate 5 (and the grounding planes 3, 4) are located outside the housing 12 and are supported by bosses. As a result, the electrical connections such as the soldering portion 8 are liable to suffer damage due to vibrations. Further, because the connections of the coaxial cable 20 are carried out by means of the receptacles 9, 21, vibrations from the car can cause the coaxial cable 20 to become loosen or fallen out from the receptacles, thereby giving rise to poor or broken connections.

Furthermore, since these types of flat antennas are usually used outdoors, it is desired that such antennas are designed so as to be able to adequately withstand environmental conditions such as rain, snow, heat and the like.

SUMMARY OF THE INVENTION

The present invention has been made in view of the problems in the prior arts as described above.

Accordingly, a main object of the present invention is to provide an integral type flat antenna provided with a converter function which makes it possible to simplify its structure and thereby provide a thinner-type flat antenna.

Another object of the present invention is to provide an integral type flat antenna provided with a converter function which has fewer parts and requires fewer manufacturing steps, and thereby enabling to easily manufacture it and lower its manufacturing costs.

The other object of the present invention is to provide an integral type flat antenna provided with a converter function which is resistant to external environmental conditions or vibrations.

In order to achieve these object, an integral type flat antenna provided with a converter function comprises an antenna element having a feeding point and an integrally formed multilayered substrate for supporting said antenna element thereon. The multilayered substrate comprises a grounding plane layer for providing an earth of said antenna element; a first insulating layer provided below said grounding plane layer; a second insulating layer having an end portion, said second insulating layer being positioned below said first insulating layer and provided with a frequency conversion circuit for carrying out a converter function on frequency of received signals, and said frequency conversion circuit having a signal input which is positioned at the end portion of said second insulating layer; and a conducting layer positioned between said first and second insulating layers for electrically connecting said feeding point of said antenna element to the signal input of said frequency conversion circuit.

According to the flat antenna having the above structure, it is provided with the integrally formed multilayered substrate constructed into a single laminated body, in which the grounding plane layer is provided at the uppermost layer for providing an earth of the antenna element, the second insulating layer on which the frequency conversion circuit is arranged is provided at the lowermost layer, and the conducting layer for serving as a feeding line that connects the feeding point of the antenna element and the input of the frequency conversion circuit is provided between these grounding plane layer and the second insulating layer. In this way, in the multilayered substrate according to the present invention, most of the main components which are formed from the separate parts in the prior art are all incorporated into the multilayered substrate formed into a single laminated body. As a result, the flat antenna according to the present invention has a simple structure in comparison with the prior art, thereby enabling to construct it as a thinner-type flat antenna. Further, since the flat antenna according to the present invention has fewer parts and requires fewer manufacturing steps in comparison with the prior art and it does not need relatively expensive parts such as coaxial cables, the antenna can be manufactured with low costs. Furthermore, since these main components are formed into an integral body without using any coaxial cable which is removably attached, the antenna according to the present invention is resistant to vibrations and thereby there is less possibility that poor connection or the like will be caused.

In the present invention, it is preferred that the antenna element is positioned substantially at the center of said ground plane, and said conducting layer is electrically connected to said feeding point of said antenna element at a position below said antenna element and the conducting layer is formed into a strip-shaped pattern extending from said position to the signal input of said frequency conversion circuit.

If do so, by changing the width and/or thickness of said conducting layer appropriately, it is possible to determine the impedance of the conducting layer as desired. Further, it is also possible to adjust the impedance of the conducting layer by further providing a prepreg between said first and second insulating layers, and then adjusting inductance and/or thickness of said first insulating layer, said second insulating layer and/or said prepreg appropriately. In this way, according to the present invention, the impedance characteristics of the feeding line can be set easily with several ways. In this case, it is preferred that the conducting layer is formed on the lower surface of the first conducting layer via an etching process.

The present invention is also directed to an integral type flat antenna provided with a converter function, which comprises a flat housing formed into a box-like shape, an antenna element having a feeding point, and an integrally formed multilayered substrate housed within said housing. The multilayered substrate comprises at least a grounding plane layer for supporting thereon said antenna element at a substantially center portion thereof; a front end substrate layer provided with a frequency conversion circuit for carrying out a converter function on frequency of received signals and having an input for said frequency conversion circuit provided at one end of said front end substrate layer; and a conducting layer provided between said grounding plane layer and said front end substrate layer for electrically connecting said feeding point of said antenna element to said input of said frequency conversion circuit.

According to the flat antenna having the above structure, most of the main components are housed within the housing. Therefore, in addition to the advantages as described above, there is an additional advantage that the antenna is not liable to be affected by the external environmental conditions.

Other objects, structures and functions of the present invention will become more apparent from the following description of the preferred embodiment when it is considered in conjunction with the appended drawings.

DETAILED DESCRIPTION OF THE PREFERRED EMBODIMENTS

A description of the preferred embodiment of the present invention is given below with reference to FIGS. 2 and 3. At this point, it is to be noted that even though the present invention is described in the preferred embodiment as an integral type GPS antenna provided with a conversion function, the present invention is in no way limited to flat antennas having such a particular use.

Figure 2:
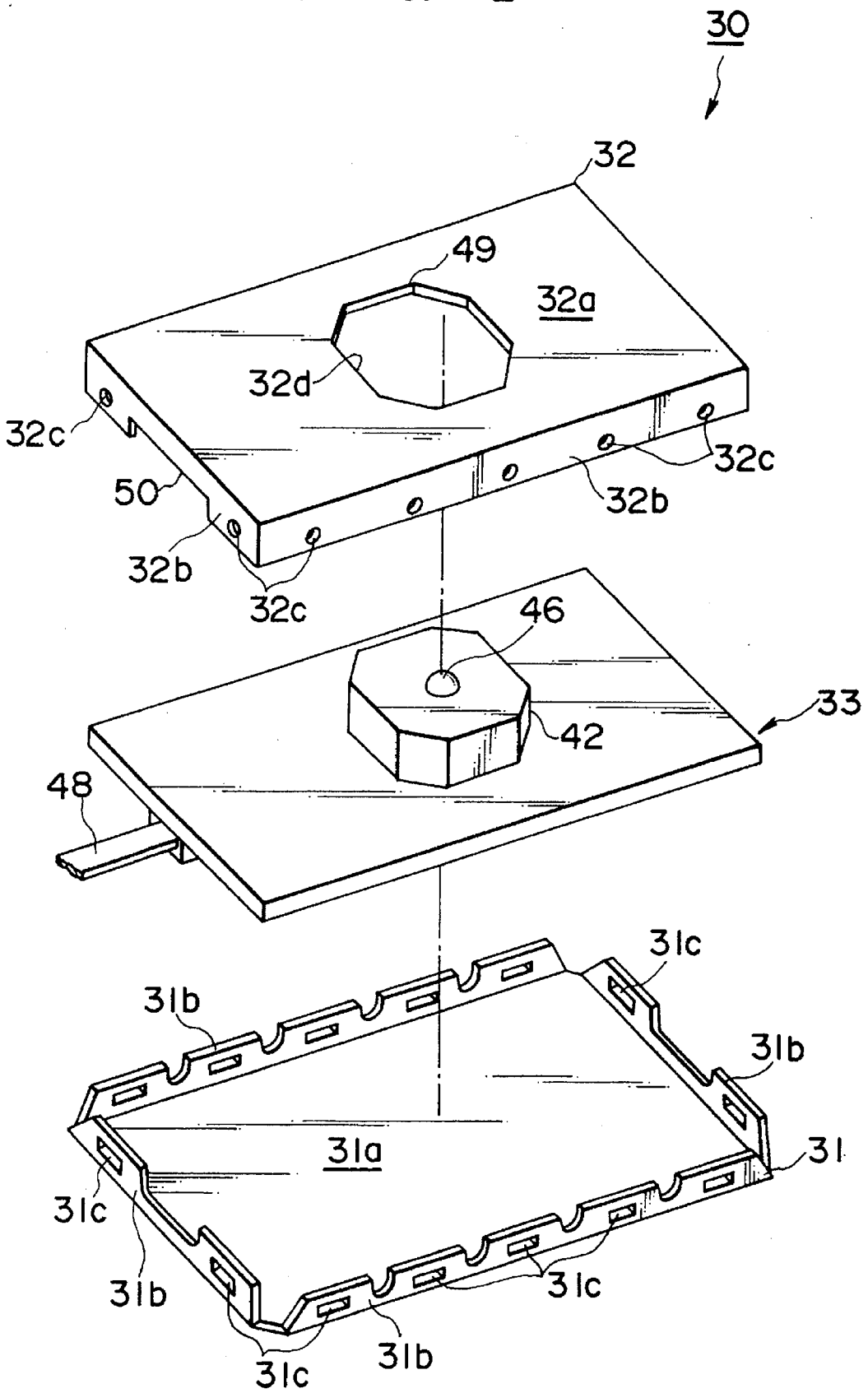
FIG. 2 is an exploded perspective view of a GPS antenna according to the preferred embodiment of the present invention.
Figure 3:
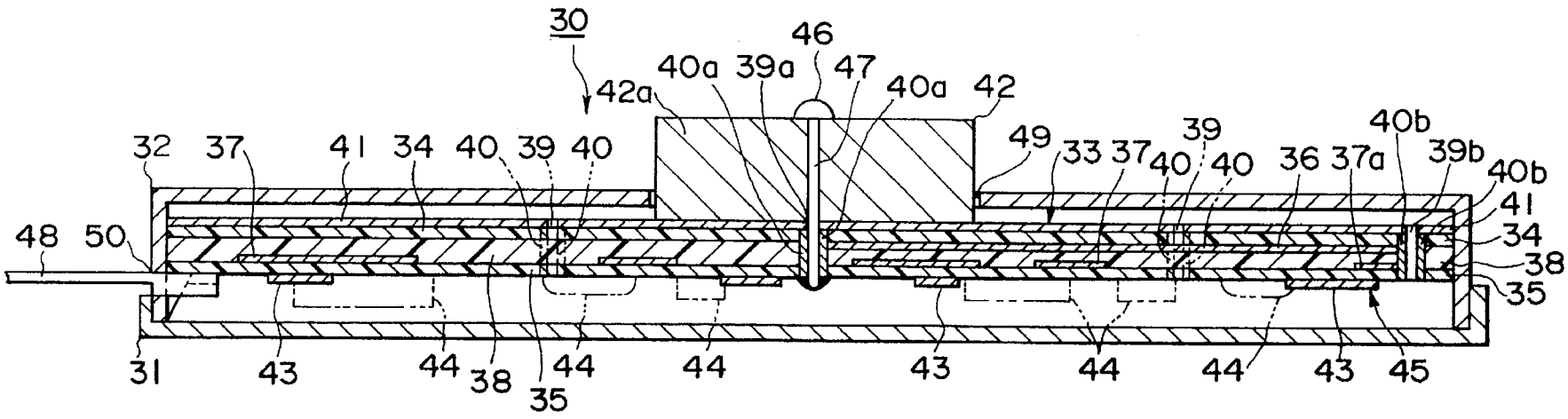
FIG. 3 is a cross-sectional view of a GPS antenna according to the preferred embodiment of the present invention.

FIG. 2 is an exploded perspective view of a GPS antenna 30 according to the present invention. The GPS antenna 30 is basically constructed from a flat, rectangular box-shaped housing which houses a multilayered substrate 33 on which an antenna element 42 is mounted.

The housing is comprised of an upper case 32 and a lower case 31 which can be separated from each other. The lower case 31 includes a roughly rectangular bottom plate portion 31*a* and four side wall portions 31*b* formed by folding the outer edges of the bottom plate portion 31*a* upwards (as viewed in the drawing). In each of the side wall portions 31*b*, there are formed a plurality of mating apertures 31*c*.

Further, the upper ease 32 includes a top plate portion 32*a*, which has a rectangular shape that is slightly smaller than that of the lower plate portion 31*a* of the lower ease 31, and four side wall portions 32*b* formed by folding the outer edges of the top plate portion 32*a* downwards to form right angles. In this way, the side wall portions 32*b* and the top plate portion 32*a* create a space for housing the multilayered substrate 33. Further, mating bosses 32*c* are formed on each side wall portion 32*b*, which are engageable with the mating apertures 31*c* formed in the side wall portions 31 of the lower case 31, respectively.

Furthermore, an octagonal opening 32*d* is formed in roughly the center of the top plate portion 32*a*, through which the antenna element 42 provided on the multilayered substrate 33 is partially protruded over the upper surface of the top plate portion 32*a*.

Now, when the antenna 30 is to be assembled, the multilayered substrate 33 is arranged inside the upper case 32 with the antenna element 42 provided on the multilayered substrate 33 being inserted into the opening 32*d* of the upper case 32, and then the upper case 32 and lower case 31 are joined together. Then, by mating the mating bosses 32*c* provided on the side wall portions 32*b* of the upper case 32 with the mating apertures 31*c* formed in the side wall portions 31*b* of the lower case 31, respectively, the GPS antenna is completely assembled. In this assembled state, an output connector 48 (described hereinbelow) of the multilayered substrate 33 extends outside the housing through an opening 50 formed in one of the matching side wall portions 31*b*, 32*b* of the upper and lower cases 32, 31.

In this regard, it is to be noted that in order to shield and ground the entire GPS antenna 30, the upper and lower cases 32, 31 of the housing are made from conducting metal sheets, preferably carbon steel or brass.

Next, with reference to FIG. 3, a description of the structure of the multilayered substrate 33 will be given below. The multilayered substrate 33 is comprised of an uppermost layer grounding plane 41 one which the antenna element 42 is mounted at the roughly central portion thereof, a first insulating layer 34 provided below the grounding plane 41, a conducting layer 36 provided on the underside surface of the first insulating layer 34, a second insulating layer 35 positioned at a prescribed spacing below the first insulating layer 34, and a frequency conversion circuit 45 which is provided on the second insulating layer 35 to carry out a conversion function on the frequency of received signals. Further, the frequency conversion circuit 45 is comprised of a signal input portion positioned at one end of the second insulating layer 35 and a signal output portion positioned at the other end of the second insulating layer 35 which is far away from the one end of the second insulating layer 35, and the conducting layer 36 is connected to a feeding point 46 of the antenna element 42 and the signal input portion 37*a* of the frequency conversion circuit 45.

Hereinafter, the detailed structure of the multilayered substrate 33 will be described in accordance with the manufacturing process thereof. First, the first and second insulating layers are formed from upper and lower epoxy substrates 34, 35 made of epoxy resin. Next, a pattern 36 which constitutes the conducting layer of the present invention is formed by an etching process on the underside surface of the upper epoxy substrate 34. As shown in FIG. 3, the pattern 36 is formed so as to extend from roughly the center of the epoxy substrate 34 to one end portion (shown in the right side in the drawing) of the epoxy substrate 34. In this way, the pattern 36 functions as a feeding line which electrically connects the feeding point 46 of the antenna element 42 with the frequency conversion circuit 45 of the multilayered substrate 33.

Further, the same etching process is used to form a pattern 37 on the upper surface of the epoxy substrate 35 (i.e., the second insulating layer).

Next, these epoxy substrates 34, 35 are heat compressed through a prepreg 38 made from semi-cured epoxy resin and then coupled together to form a laminated structure. After this laminating process is completed, a drill is used to form through-holes 39, 39*a*, 39*b* at prescribed positions, and then through-hole platings 40, 40*a*, 40*b* are respectively formed at such positions. In this case, the through-hole plating 40*a* of the through-hole 39*a*, which is formed in roughly the center portion of the multilayered substrate 33, and the through-hole plating 40*b* of the through-hole 39*b*, which is formed in the vicinity of the signal input portion 37*a* of the frequency conversion circuit 45 positioned at one end portion of the multilayered substrate 33, are electrically connected to the pattern 36 which forms the conducting layer in this regard, it should be noted that in the present embodiment, the pattern 36 is formed into a strip-shaped pattern that extends from roughly the center of the multilayered substrate 33 toward the signal input portion 37*a*.

In this case, by appropriately adjusting factors such as the dielectric constant, width and/or thickness of the epoxy substrate 34 and prepreg 38, the pattern (the conducting layer) 36 is formed such that it has a predetermined impedance (e.g., 50 Ω)

Next, the grounding plane 41 for the antenna element 42 is formed by applying a copper foil on the upper surface of the upper epoxy substrate 34, which forms the uppermost layer of the multilayered substrate 33. The grounding plane 41 is electrically connected to the upper case 32 of the housing 130 in order to ground the antenna element 42. In this regard, It should be noted that since the grounding plane 41 is arranged on the upper surface of the upper epoxy substrate 34 except for the through-hole portions 39, 39*a*, 39*b*, the grounding plane 41 is electrically insulated from the through-hole platings 40, 40*a*, 40*b*.

Further, a circuit pattern 43 is formed by a copper foil etching process on the underside surface of the lower epoxy substrate 35, namely on the lowermost surface of the multilayered substrate 33. On the circuit pattern 43, many electrical parts 44, 44 such as integrated circuits, oscillators, resistors and the like are mounted. In this way, the frequency conversion circuit 45 is formed by the electrical parts 44, 44, the pattern 37 and the circuit pattern 43. In this structure, the epoxy substrate 35 on which such a frequency conversion circuit 45 is formed constitutes a front end substrate.

The frequency conversion circuit 45 performs a conversion function on the frequency of the signals based on received electromagnetic waves, in which the signal input portion 37*a* is provided in the vicinity of the one end portion (shown in FIG. 3 as the right end portion) of the multilayered substrate 33. The input portion 37*a* is electrically connected to the through-hole plating 40*b* of the through-hole 39*b*. Further, the output connector 48 which forms the signal output portion is provided at the other end portion (shown in FIG. 3 as the right end portion) of the multilayered substrate 33. In this way, the frequency conversion circuit 45 is designed to enable electrical signals to flow from the signal input portion 37*a* to the signal output portion in a substantially linear manner.

In this connection, it should be noted that a part of the circuit pattern 43 provided on the underside surface of the multilayered substrate 33 simultaneously functions as a grounding plane of the frequency conversion circuit 45. For this reason, a part of the circuit pattern 43 is soldered to the upper case 31 in order to establish a ground with the housing. Further, in this way the multilayered substrate 33 is fixed to the inside of the upper case 31.

Now, as shown in FIGS. 2 and 8, the antenna element 42 is mounted on roughly the center portion of the grounding plane 41 which is arranged on the uppermost surface of the multilayered substrate 38. By mounting the antenna element 42 on the grounding plane 41 in this way, the antenna element 42 is grounded, and this makes it possible to stabilize the antenna characteristics.

The antenna element 42 is comprised of a roughly octagonal column-shaped dielectric portion 42*a* which is insertable through the opening 32*d* of the upper case 32. The dielectric portion 42*a* is made of dielectric substance such as ceramic or the like. A metal feeding point 46 is provided in roughly the center of the top end surface of the dielectric portion 42*a*. Further, a terminal 47 extends from the feeding point 46 through the inside of the conducting portion 42*a*. The terminal 47 is press fitted through the previously formed through-hole 39*a* of the multilayered substrate 33 and is electrically connected to the through-hole plating 40*a*. Further, the lower end of the terminal 47 protrudes below the underside surface of the lowermost layer epoxy substrate 35 of the multilayered substrate 33, and such lower protruding portion of the terminal 47 is soldered to fix it in place.

Hereinbelow, a description of the operation of the above-described flat antenna 30 will be given. First, electromagnetic waves transmitted from satellites are received by the antenna element 42, thereby generating an induced electrical current at the feeding point 46. Next, electrical signals based on such induced electrical current are sent to the through-hole plating 40*a* of the through-hole 39*a* of the multilayered substrate 88 via the terminal 47 which is connected to the feeding point 46. Then, after being transmitted from the through-hole plating 40*a* to the through-hole plating 40*b* of the through-hole 39*b* via the pattern 36 which forms a conducting layer, such electrical signals are sent from the through-hole plating 40*b* to the signal input portion 37*a* of the frequency conversion circuit 45. In the frequency conversion circuit 45, the electrical signals flow in a substantially linear manner from the signal input portion 37*a* toward the output connector 48 in accordance with the circuit structure as described above, and in so doing the electrical signals pass through various circuit elements which carry out a frequency conversion on such electrical signals to lower the frequency thereof. The electrical signals of which frequency have been thus converted are outputted from the signal output connector to a receiver or the like (not shown in the drawings).

In this way, the multilayered substrate 33 according to the present invention can carry out the three functions performed by the separate components in the prior art integral type GPS antennas provided with converter functions, namely the antenna substrate which is used for grounding the antenna element, the front end substrate which has the frequency conversion circuit and the feeding line such as the coaxial cable. Thus, in contrast with such prior art antennas which have one substrate provided inside a case and another substrate provided above the case, the present invention has only one substrate provided within a housing. Further, since the present invention has no need for providing a feeding line such as the coaxial cable used in the prior art, the present invention makes it possible to simplify its structure and thereby provide a thinner-type flat antenna.

Further, by using such a multilayered substrate as described above, the present invention has fewer parts and requires fewer manufacturing steps in comparison with prior art antennas. In addition, since the flat antenna of the present invention utilizes a feeding line which is constructed from a pattern formed on the multilayered substrate, there is no need for relatively expensive parts such as coaxial cables which are used in the prior art. As a result, the present invention simplifies the manufacturing process and thereby lowers manufacturing costs.

Furthermore, since most of the main components are integrally formed in the multilayered substrate, there are no parts such as coaxial cables and the like which are liable to be loosen by vibrations, and therefore the antenna according to the present invention is resistant to vibrations and the like.

Moreover, because the lower case 31 can be removed to directly expose the electrical parts of the frequency conversion circuit 45 and the like, it is easy to carry out maintenance on the antenna according to the present invention.

Figure 1:
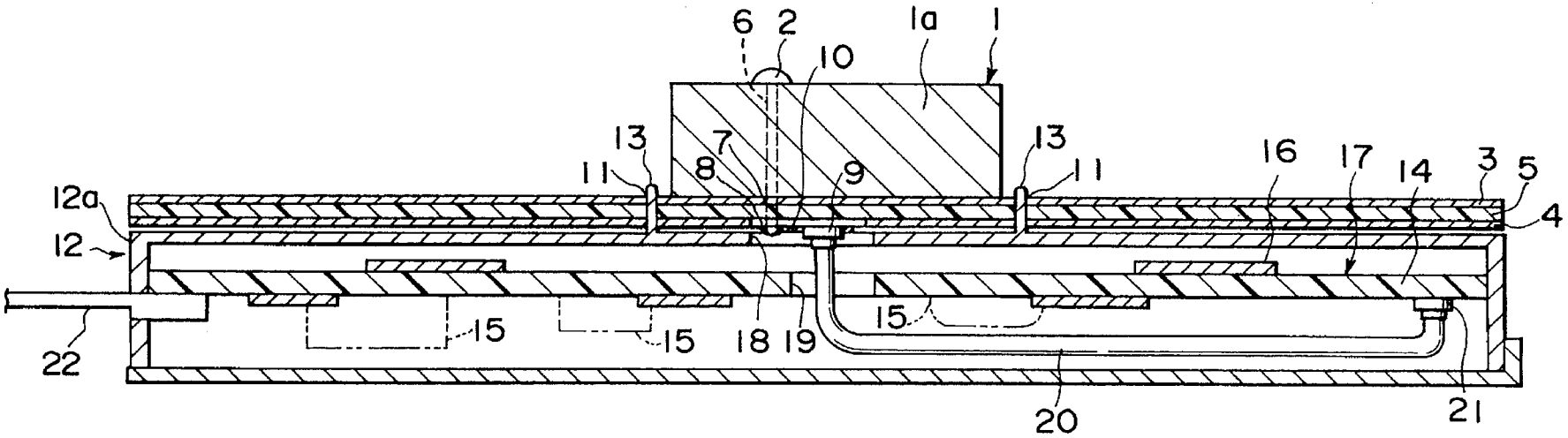
FIG. 1 PRIOR ART
FIG. 1 is a cross-sectional view of a prior art GPS antenna.

Furthermore, except for the antenna element 1, all the components of the antenna according to the present invention are housed within a housing 130. Thus, In contrast with prior art antennas as shown In FIG. 1, the antenna according to the present invention is resistant to outside environmental conditions such as rain, snow, etc.

In the above descriptions, even though the present invention was described for the case where it is applied to an integral type GPS flat antenna provided with a converter function, the present invention Is in no way limited to such application. Instead, the flat antenna according to the present invention can also be appalled to other flat antennas used for receivers for receiving other types of satellite transmission waves or satellite communication waves. In such cases, the antenna element would preferably comprise a dielectric body formed into a flat shape and an antenna circuit formed on top of such conducting body, in which the antenna circuit is preferably formed from a microstrip pattern which acts as a feeding point.

Finally, it is to be noted that many changes and additions may be made to the antenna of the present invention without departing from the scope and spirit of the invention as defined in the appended claims.

What claimed is:

1. An integral type flat antenna provided with a converter function comprising:

an antenna element having a feeding point; and an integrally formed multilayered substrate for supporting said antenna element thereon, said multilayered substrate comprising:

a grounding plane layer for providing earth of said antenna element;

a first insulating layer provided below said grounding plane layer;

a second insulating layer provided having an end portion, said second insulating layer being positioned below said first insulating layer and provided with a frequency conversion circuit for carrying out a converter function on frequency of received signals, and said frequency conversion circuit having a signal input which is positioned at the end portion of said second insulating layer;

a third layer provided between said first and second layers; and a flat plate-shaped conducting layer positioned between said first and third insulating layers for electrically connecting said feeding point of said antenna element to the signal input of said frequency conversion circuit.

2. The flat antenna as claimed in claim 1 wherein said antenna element is positioned substantially at the center of said ground plane in which said conducting layer is electrically connected to said feeding point of said antenna element at a position below said antenna element, the conducting layer is formed into a strip-shaped pattern extending from said position to the signal input of said frequency conversion circuit, and said conducting layer is connected to said signal input by means of an electrical connecting means which passes the third layer in a direction of its thickness.

3. The flat antenna as claimed in claim 2, wherein width and/or thickness of said conducting layer is set such that said conducting layer has a predetermined impedance.

4. The flat antenna as claimed in claim 2 wherein said third layer is formed of a prepreg, in which inductance and/or thickness of said first insulating layer and/or said prepreg is set such that said conducting layer has a predetermined impedance.

5. The flat antenna as claimed in claim 1, further comprising a flat housing having a top surface for accommodating said multilayered substrate therein, and said antenna element is partially protruded above the top surface of said housing.

6. The flat antenna as claimed in claim 5, wherein said grounding plane layer is electrically connected to said housing to establish an earth of said antenna element.

7. An integral type flat antenna provided with a converter function comprising:

a flat housing formed into a box-like shape;

an antenna element having a feeding point; and an integrally formed multilayered substrate housed within said housing, said multilayered substrate comprising:

a grounding plane layer for supporting thereon said antenna element at a substantially center portion thereof;

a front end substrate layer provided with a frequency conversion circuit for carrying out a converter function on frequency of received signals and having an input for said frequency conversion circuit provided at one end of said front end substrate layer; and a flat plate-shaped conducting layer provided between said grounding plane layer and said front end substrate layer for electrically connecting said feeding point of said antenna element to said input of said frequency conversion circuit.

8. The flat antenna as claimed in claim 7 wherein said conducting layer is electrically connected to said feeding point of said antenna element at a position below said antenna element, and said flat plate-shaped conducting layer is formed into a strip shaped pattern at least extending from said position to said input of said frequency conversion circuit.

9. The flat antenna as claimed in claim 8, wherein a width and/or thickness of said conducting layer is set such that said conducting layer has a predetermined impedance.

10. The flat antenna as claimed in claim 8 further comprising:

an insulating layer provided between said grounding plane layer and said front end substrate layer, and a prepreg provided between said insulating layer and said front end substrate layer, and said conducting layer is connected to said signal input by means of an electrical connecting means which passes the prepreg in a direction of its thickness.

11. The flat antenna as claimed in claim 10, wherein inductance and/or thickness of said insulating layer and/or said prepreg is set such that said conducting layer has a predetermined impedance.

12. The flat antenna as claimed in claim 7, wherein said front end substrate layer has a circuit pattern, and a part of said circuit pattern is electrically connected to said housing to establish a grounding plane for said frequency conversion circuit.

* * * * *